US006582588B1

(12) United States Patent
Zimmerman et al.

(10) Patent No.: US 6,582,588 B1
(45) **Date of Patent: *Jun. 24, 2003**

(54) HIGH TEMPERATURE, LOW OXIDATION STABILIZATION OF PITCH FIBERS

(75) Inventors: Andrea K. Zimmerman, Wilmington, DE (US); John A. Rodgers, Dayton, TN (US); H. Ernest Romine, Ponca City, OK (US); James R. McConaghy, Ponca City, OK (US); Lorita Davis, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/514,668

(22) Filed: Feb. 28, 2000

Related U.S. Application Data

(63) Continuation of application No. 09/052,764, filed on Mar. 31, 1998, now Pat. No. 6,123,829.
(60) Provisional application No. 60/042,762, filed on Apr. 9, 1997.

(51) Int. Cl.[7] ..... C10G 27/00
(52) U.S. Cl. ..... 208/6; 208/4; 208/39; 208/44; 423/447.6; 423/447.7
(58) Field of Search ..... 208/4, 6, 39, 44; 423/447.6, 447.7

(56) References Cited

U.S. PATENT DOCUMENTS 3,974,264 A 8/1976 McHenry
3,976,729 A 8/1976 Lewis et al.
4,314,981 A 2/1982 Miyamori et al.
4,497,789 A 2/1985 Sawran et al.
4,576,810 A 3/1986 Redick
4,582,662 A 4/1986 Koga et al.
4,608,402 A 8/1986 Redick et al.
4,657,753 A * 4/1987 Bolt et al. ..... 423/447.6
4,927,620 A 5/1990 Ward et al.
4,975,263 A * 12/1990 Furuyama et al. ..... 264/29.2
5,037,590 A * 8/1991 Fukushima ..... 264/211.11
5,061,413 A 10/1991 Uemura et al.
5,259,947 A 11/1993 Kalback et al.
5,292,408 A * 3/1994 Tanigawa et al. ..... 205/661
5,437,780 A 8/1995 Southard et al.
5,501,788 A 3/1996 Romine et al.
5,540,832 A 7/1996 Romine
5,997,613 A * 12/1999 Kaneko et al. ..... 95/117
6,123,829 A * 9/2000 Zimmerman et al. ..... 208/39

* cited by examiner

*Primary Examiner*—Walter D. Griffin

(57) ABSTRACT

The present invention provides a process for thermosetting pitch fibers in reduced times, at low concentrations of oxygen and at higher temperatures than previously possible. Additionally, the present invention provides a pitch fiber which has an oxygen diffusion rate to the center of the fiber which is competitive with the rate of oxidation at the fiber's surface. Further, the present invention provides a high density pitch fiber batt which thermosets without loss of fiber structure.

13 Claims, No Drawings

HIGH TEMPERATURE, LOW OXIDATION STABILIZATION OF PITCH FIBERS

This is a continuation of U.S. application Ser. No. 09/052,764, filed on Mar. 31, 1998, now U.S. Pat. No. 6,123,829, issued on Sep. 26, 2000, which is incorporated herein by reference in its entirety and claims priority to U.S. Provisional Application Serial No. 60/042,762, filed on Apr. 9, 1997.

I. BACKGROUND OF THE INVENTION

This invention relates to the field of preparing carbon fibers from carbonaceous pitches. A typical process for manufacturing pitch based carbon fibers may include the following steps: (1) preparing a suitable pitch for spinning; (2) spinning the pitch into as-spun pitch fibers; (3) thermosetting (stabilizing) the pitch fibers to render them infusible, i.e. unmeltable; and, (4) carbonizing the fibers by heating the stabilized fibers to carbonization temperatures.

In the described process, the as-spun pitch fiber of step (2) is a thermoplastic material. Thus, additional heating of the fiber results in melting and loss of fiber structure. Therefore, prior to carbonization, the fiber must be rendered unmeltable, i.e. thermoset. The thermosetting process is commonly known as oxidative stabilization due to the heating of the fiber in the presence of an oxidizing agent. Typical stabilization processes expose the as-spun fibers to a high concentration of oxidizing agent at an initial process temperature lower than the fiber's spinning temperature.

The stabilization process involves temperature dependent diffusion of oxygen into the fiber where the oxygen reacts with and promotes cross-linking of the pitch molecules. Because the reaction rate is temperature dependent, lower stabilization temperatures require longer times to complete the oxidative stabilization of the fiber. The total oxygen required for stabilization will depend on the nature of the pitch. Generally, low softening point pitches require long periods of time and more oxygen to complete the stabilization process. Typically, the oxidizing agent is air (approximately 21% oxygen).

To improve operating economics, one would prefer to stabilize (thermoset) the as-spun fiber at high temperatures under high oxygen concentrations in order to complete the stabilization process in the shortest period of time. Unfortunately, high oxygen concentrations and elevated temperatures increase the possibility of uncontrolled exothermic oxidation reactions. Reactions of this type are particularly hazardous when highly volatile hydrocarbons are present. Most current art practices minimize the risk of thermal runaway by limiting the processing temperature and quantity of exposed fiber.

In addition to the need to prevent an uncontrolled exothermic reaction and loss of carbon mass, the stabilization process must also preserve the structure of the fiber. Accordingly, the heating temperature must not exceed the fiber's softening point. Therefore, fibers prepared from soft, low melting pitches must be stabilized at lower temperatures than fibers prepared from hard, high melting pitches.

Clearly, when treating a large amount of fiber over a short period of time the current manufacturing methods have significant drawbacks.. The need to limit temperature, oxidant concentration and quantity of fiber in the stabilization process creates higher than desirable costs, diminishes the value and strength of the fiber and creates obvious operating risks. In overcoming the deficiencies of the current processes, a preferred method would utilize a low concentration of oxidizing agent coupled with high temperature heating while avoiding the risk of thermal runaway and loss of fiber size. Preferably, such a method would yield stabilized fibers in a short period of time and generate increased operating efficiencies.

To achieve these goals, the present invention provides a process for stabilizing pitch fibers using low concentrations of oxidizing agent at high temperature in a short period of time. This novel process stabilizes the core of the fiber without excessive surface oxidation. Additionally, the current invention provides a pitch fiber which becomes stabilized at its core at a rate which is sufficient to preclude excess loss of carbon at the fiber's surface due to oxidation. Further, the fibers take up a minimal amount of oxygen. These and other benefits of the present invention are described in greater detail below. For the purposes of this disclosure, the terms "stabilizing" and "thermosetting" are used interchangeably.

II. BRIEF DESCRIPTION OF THE INVENTION

The present invention provides a novel process for stabilizing pitch fibers. According to the disclosed process, the pitch fibers are heated at a temperature equal to or greater than the spinning temperature of the fibers. During the heating process, the fibers are exposed to an oxidizing agent for a period of time sufficient to stabilize, i.e. thermoset, the fibers.

Additionally, the present invention provides a process for stabilizing pitch fibers using continuous heating in the presence of a stream of gas. This process provides a means of significantly reducing the risk of uncontrolled exothermic reactions. According to this novel process, the pitch fibers are heated to a temperature at least equal to the spinning temperature of the fibers. During the heating process, the fibers are contacted with a flowing gas which contains an oxidizing agent. The flow rate of the gas is sufficient to remove excess heat from the fibers during the stabilization process thereby controlling the exotherm of the reaction. Exposure of the fibers to the oxidizing agent is maintained for a period of time sufficient to stabilize the fibers.

Further, the present invention provides a pitch fiber having a softening point of at least 300° C. The novel fiber has an oxygen diffusion rate to its center which is approximately equal to, or greater than, the oxidation rate at the fiber's surface. Thus, the fiber's center becomes oxidatively stabilized at a rate ranging from slightly less than, to greater than the rate of consumption of carbon by oxygen at the fiber's surface. In this manner, the current invention precludes excess loss of carbon at the surface of the fiber. Oxidative stabilization of the fiber may be carried out at temperatures equal to or greater than the fiber's spinning temperature in an atmosphere containing up to ten percent oxidizing agent by volume. Preferably, the concentration of oxidizing agent will be less than eight percent by volume. Finally, depending upon operating conditions and raw material used, these fibers may be oxidatively stabilized in less than ten minutes.

The current invention additionally provides a pitch fiber batt having a density of at least 900 g/m$^2$ which is capable of being oxidatively stabilized. Despite the high density of fibers, the novel pitch fiber batt oxidatively stabilizes without loss of fiber structure when heated in a flowing gas stream containing an oxidizing agent.

III. DETAILED DISCLOSURE OF THE INVENTION

The following discussion will focus on the stabilization of pitch fibers. However, the current invention is equally applicable to the stabilization of other artifacts prepared from pitch.

A. High Temperature Stabilization of Pitch Fibers

The stabilization of pitch fibers is a process which cross-links the large aromatic molecules of the pitch. Oxygen also reacts with pitch carbon to form gaseous carbon oxides in a process known as burnoff. If diffusion is relatively slow, oxidation at the surface (burnoff) dominates while the fiber's center remains unstabilized. If diffusion is relatively fast, oxygen penetrates and stabilizes (cross-links) the interior of the pitch artifact with little surface burnoff. According to the current invention, the oxygen diffusion rate into the pitch fiber to effect stabilization must be comparable to or faster than the rate at which oxygen reacts to consume carbon at the fiber's surface. Thus, the fibers may be stabilized at process temperatures of 300° C. and above.

Prior to the current invention, those skilled in the art believed that stabilization conditions of high temperature and low oxygen concentrations would produce excessive burnoff of the fiber's surface due to insufficient oxygen diffusion to the center of the fiber. Ultimately, the burnoff would weaken or destroy the fiber. As discussed above, increasing the concentration of oxygen at high temperatures as a means of increasing the reaction rate is not an option due to the risks of fiber melting and excessive exothermic reactions. In spite of the teachings of the prior art, the examples provided below clearly demonstrate that the present invention provides a process for stabilizing pitch fibers at high temperatures and low concentrations of an oxidizing agent.

In the preferred embodiment of the current invention, the oxidizing agent is oxygen at a concentration of eight percent (8%) by volume in a carrier gas. The preferred carrier gas is nitrogen. This novel process utilizes pitch fibers which have softening points in excess of 300° C. These fibers may be prepared by spinning solvated mesophase pitch followed by removal of the solvating solvent from the as-spun pitch fibers. The process of preparing solvated mesophase pitch is disclosed in U.S. Pat. Nos. 5,259,947; 5,437,780 and 5,540,903 incorporated herein by reference. Further, the preparation of fibers from solvated mesophase pitch is discussed in U.S. patent application Ser. No. 08/791,443, now U.S. Pat. No. 5,766,523 and U.S. Pat. No. 5,648,041 incorporated herein by reference.

In the current process, fibers are prepared by spinning solvated mesophase pitch at a temperature in the range of 220° C. to 340° C. Following spinning of the fibers, the solvating solvent is removed from the as-spun pitch fibers. Typically, the solvent is removed by evaporation aided by heating and exposure of the fiber to a flowing gas. However, the method of removing the solvent is not critical to the current invention. Removal of the solvent increases the softening point of the fibers by at least 400° C. Frequently, removal of the solvent will raise the softening point of the fiber by 100° C. or more.

In the preferred embodiment of the current invention, solid pitch fiber is rapidly heated to an initial process temperature. The initial process temperature is greater than the spinning temperature of the fiber; yet, lower than the softening point of the pitch prior to solvation (dry pitch). The initial process temperature may range from 100° to 900° C. below the softening point of the dry pitch. Preferably, the initial process temperature is at least 400° C. below the softening point of the dry pitch. Accordingly, the initial process temperature may range from 250° C. to 500° C. with a preferred initial process temperature of at least 300° C.

In general, the fibers are heated at a rate sufficient to reach the initial process temperature in less than 15 minutes and preferably less than 5 minutes. To effect stabilization, the present invention maintains the initial process temperature for 1 to 60 minutes. Following this initial time period, the temperature may be increased if additional stabilization is required; however, the process temperature must be maintained below the fiber's instantaneous softening point. Total stabilization time will depend on a number of factors including fiber melting temperature, fiber diameter, oxidant concentration and oxidation temperature. Typically, the total processing time will range from about 1 to about 150 minutes. Preferably, the total heating time is less than 60 minutes. More preferably, the total heating time will be less than 10 minutes.

During the described heating process, a flowing gas stream containing an oxidizing agent contacts the fibers. The concentration of oxidizing agent may range from approximately 2% by volume to nearly 21%. Preferably, the concentration of oxidizing agent will be less than 10% by volume. In general, the process of the present invention utilizes oxygen as the oxidizing agent and nitrogen as the carrier gas. However, other oxidizing agents and gases will function within the scope of the current invention. For example, mild oxidizing gases such as oxides of nitrogen, oxides of sulfur, carbon dioxide, chlorine, or mixtures thereof with or without a carrier gas will also function within the scope of the current invention.

The gas stream described above serves two purposes. First, it carries the oxidizing agent into contact with the pitch fibers. Second, passage of the gas stream through the fibers removes excess heat from the fibers. Thus, the present invention allows one to control the exothermic reaction inherent in the stabilization process by varying the flow rate of the gas, the concentration of oxygen and the density of the fiber batt. Preferably, these variables will be balanced such that the exothermic reaction will increase temperatures by less than 50° C. In this manner, the present invention significantly reduces the risk of uncontrolled thermal reactions.

The following examples are intended to aid in an understanding of the current invention and are not considered limiting of the scope of the invention. In the following examples, complete stabilization is determined by exposing the fibers to the open flame of a match until the fibers become incandescent. Fibers are deemed fully stabilized if they do not melt during the "match test". Volumes indicated in the following examples are considered to be measured at standard temperature and pressure.

EXAMPLE 1

Prior Art Method of Stabilization

A refinery decant oil was topped to produce a 454° C.$^+$ residue. This residue tested 82% aromatic carbons by $C_{13}$ NMR. The decant oil residue was heat soaked 6 hours at 390° to 400° C. and then vacuum deoiled to produce an isotropic heat soaked pitch.

Heat soaked pitch was solvent fractionated by fluxing the pitch, filtering and then rejecting mesogens. Crushed pitch was combined 1 to 1 weight to weight with hot toluene to form a flux mixture. The flux mixture was stirred at 110° C. until all pitch chunks disappeared. Celite filter aid was added and the mixture was filtered to remove flux insolubles.

Hot flux filtrate was combined with additional solvent to precipitate mesogens. The additional solvent was a comix of toluene and a minor amount of heptane. Each kilogram of heat soaked pitch was combined with a total of 6.9 liters of comix solvent to precipitate mesogens in the flux filtrate. The mixture was heated to 100° C. and then cooled to 30° C. and the insoluble mesogens were collected by filtration. The insolubles were washed with solvent and then dried. The insolubles were observed to soften at 310° C. and melt at 335° C.

The pitch was melted and spun into fibers at 381° C. The green or as-spun fibers were 42 microns in diameter. The green fibers were oxidized in a TGA apparatus at 260° C. in air at 60 ml/min for times of 90 and 120 minutes. Fibers oxidized for 90 minutes gained 3.0 wt % while those oxidized for 120 minutes gained 4.8 wt %. The fibers treated for 120 minutes passed the match test while the sample treated to 90 minutes failed.

EXAMPLE 2

Prior Art Stabilization of Higher Melting Pitch Fiber

A refinery decant oil was vacuum fractionated to produce a 393° to 510° C. distillate. The distillate was heat soaked 2.6 hours at 440° C. to produce an isotropic heat soaked pitch. A mesogen residue was precipitated from the heat soaked pitch by extraction of light components. Heat soaked pitch was combined with 4.75 parts by weight of xylene and mixed at autogenous pressure at about 240° C. The resulting insolubles were dried of solvent. The dried insolubles were combined with 22 weight percent phenanthrene and mixed as a melt to form a solvated mesophase pitch. This pitch was 93 volume percent anisotropic and tested 1000 poise viscosity at 209° C. Dried insolubles from this pitch softened at 384° C. and melted at 395° C. The solvated mesophase was spun at 270° C. to form a 42 micron diameter green fiber. The fiber was dried of phenanthrene and then oxidized in a TGA at 260° C. in air at 60 ml/min for times 45 and 60 minutes. Fibers oxidized for 45 minutes gained 1.6 wt % while those oxidized for 60 minutes gained 2.4 wt %. Fibers oxidized for 60 minutes passed the match test while fibers oxidized for 45 minutes failed the match test.

Example 2 shows that higher melting pitch fibers stabilize faster than the conventional pitch fibers of Example 1 when treated at the same conditions. This indicates that less oxygen is required to convert the higher melting heavy pitch component of the solvated mesophase to a thermoset material.

EXAMPLE 3

Stabilization of High Melting Pitch Fibers in Air

A refinery decant oil was vacuum fractionated to produce a 399° to 516° C. distillate. This distillate tested 70% aromatic carbons by $C_{13}$ NMR. The distillate was heat soaked 11.5 hours at 413° C. to produce an isotropic heat soaked pitch.

A mesogen residue was precipitated from the heat soaked pitch by extraction of light components. Heat soaked pitch was combined with 3.05 parts by weight of xylene and mixed at autogenous pressure at about 240° C. The resulting insolubles were dried of solvent. The dried insolubles were combined with 22 weight percent phenanthrene and mixed as a melt to form a solvated mesophase pitch. This pitch was 94 volume percent anisotropic and tested 1000 poise viscosity at 216° C. Dried insolubles from this pitch softened at 393° C. and melted at 422° C. The solvated mesophase was spun at 254° C. to form a 14 micron diameter green fiber. The fiber was dried of phenanthrene and then oxidized in a 2.54 cm diameter test cylinder in air with a flow rate of 37 l/min at 260° C. for times of 15 (340 g/m$^2$), 25 (197 g/m$^2$) and 30 (494 g/m$^2$) minutes. The numbers given in parentheses are the area densities for the fiber batts used in these tests. The samples were analyzed for oxygen content using a LECO RO-478 Oxygen Determinator. Fibers treated for 15, 25, and 30 minutes contained 2.6, 3.4, 4.0 wt % oxygen respectively. Fibers oxidized for 25 and 30 minutes passed the match test while those oxidized for 15 minutes did not.

EXAMPLE 4

Stabilization in 4% Oxygen at 260° C.

The same 14 micron diameter green fiber of Example 3 was dried and then oxidized in a 2.54 cm test cylinder in 4% oxygen in nitrogen with a flow rate of 37 l/min at 260° C. for times of 50(286 g/m$^2$) and 125(265 g/m$^2$) minutes. The numbers given in parentheses are the area densities for the fiber batts used in these tests. The samples were analyzed for oxygen content using a LECO RO-478 Oxygen Determinator. Fibers treated for 50 and 125 minutes contained 2.0 and 3.3 wt % oxygen respectively. Fibers oxidized for 125 minutes passed the match test while those oxidized for 50 minutes did not.

Example 4 demonstrates the complete stabilization of the fiber at low oxygen concentration. This example also shows the expected slower oxidation at lower oxygen concentration.

EXAMPLE 5

Stabilization in 4% Oxygen at 350° C.

Fibers made from solvated pitch as described in Example 3 and spun at 254° C. to diameters of 15–20 microns were dried and then oxidized in a 2.54 cm test cylinder in 4% oxygen in nitrogen with a flow rate of 37 l/min at 350° C. for times of 3(1715 g/m$^2$), 4(1871 g/m$^2$), and 8(284 g/m$^2$) minutes. The numbers given in parentheses are the area densities for the fiber batts used in these tests. The samples were analyzed for oxygen content using a LECO RO-478 Oxygen Determinator. Fibers treated for 3 and 8 minutes contained 0.7 and 1.7 wt % oxygen respectively. Fibers oxidized for 4 and 8 minutes passed the match test while those oxidized for 3 minutes did not. Some of the oxidized fibers were also carbonized to 1600° C. in nitrogen and scanning electron microscopy was used to confirm complete stabilization.

EXAMPLE 6

Stabilization in 2% Oxygen at 350° C.

Fibers made as described in Example 5 were dried and then oxidized in a 2.54 cm test cylinder in 2% oxygen in nitrogen with a flow rate of 37 l/min at 350° C. for times of 6 (2247 g/m$^2$) and 10 (1802 g/m$^2$) minutes. The numbers given in parentheses are the area densities for the fiber batts used in these tests. The samples were analyzed for oxygen content using a LECO RO-478 Oxygen Determinator. Fibers treated for 6 and 10 minutes contained 1.1 and 0.8 wt % oxygen respectively. At the end of the oxidizing treatment the fibers oxidized for 10 minutes passed the match test.

Examples 5 and 6 show the unique rapid and complete stabilization of high melting pitch fibers of the invention at high temperatures and low oxygen concentrations. The examples show the lower oxygen content required to stabilize these fibers as well as the complete diffusion of the oxygen into the center of the fiber at the higher stabilization temperatures. In addition, these fibers can be oxidized at high batt densities without significant risk of an uncontrolled exotherm. The following table provides a summary of the operating conditions and results of each example.

| | Ex. 1 | Ex. 2 | Ex. 3 | Ex. 4 | Ex. 5 | Ex. 6 |
|---|---|---|---|---|---|---|
| Softening Point ° C. (dry pitch) | 310 | 384 | 393 | 393 | 393 | 393 |
| Spinning Temp. ° C. | 381 | 270 | 254 | 254 | 254 | 254 |
| Oxidation Temp. ° C. | 260 | 260 | 260 | 260 | 350 | 350 |
| Percent $O_2$, by volume | 21 | 21 | 21 | 4 | 4 | 2 |
| Treatment Time, minutes | 90, 120 | 45, 60 | 15, 25, 30 | 50, 120 | 3, 4, 8 | 6, 10 |
| Match Test Pass/Fail | Fail, Pass | Fail, Pass | Fail, Pass, Pass | Fail, Pass | Fail, Pass, Pass | Fail, Pass |

B. Pitch Fiber Having Improved Oxygen Diffusion Rate

Prior to the development of the current pitch fibers, the stabilization of fibers at high temperatures and low concentrations of oxygen was not possible. In contrast to previous pitch fibers, the novel pitch fibers of the present invention are characterized by their ability to rapidly thermoset at high temperatures and low concentrations of oxygen. Further, the pitch fibers of the present invention have softening points in excess of 300° C. and preferably greater than 350° C. Thus, these fibers may be subjected to the stabilization process at temperatures greater than the fiber spinning temperature.

One of the novel characteristics of the present fibers is an oxygen diffusion rate to the center of the fiber which is approximately equal to or greater than the surface oxidation rate of the fiber. The fibers retain this characteristic even when stabilized at temperatures in excess of 300° C. and at oxygen levels of 2–4% by volume. The preferred fibers of the present invention will be suitable for stabilization at temperatures in excess of 350° C. and oxygen levels ranging from 2–21% by volume and preferably in the range of 2–10% by volume. Typically, these fibers will be completely stabilized in about 2 to 30 minutes.

These novel fibers provide significant advantages over previously known pitch fibers. As a result of the rapid stabilization, the pitch fibers of the present invention dramatically reduce operating costs during the preparation of carbon fibers. Further, these novel fibers enhance safety conditions during the stabilization process by operating at oxygen concentrations below the lower explosive or flammability limit of the solvent vapor and stabilization byproducts.

When collected as a batt, these fibers generate a fiber batt which is readily stabilized. Specifically, fiber batts with densities as great as 900 g/m$^2$ and higher may be stabilized without significant risk of thermal runaway. As in the case of the fibers, the batts are heated in the presence of a flowing stream of gas. Typically, the flowing stream of gas contains up to 8% by volume of an oxidizing agent as previously described. The preferred oxidizing agent being oxygen and the preferred carrier gas being nitrogen; however, other combinations are contemplated as previously discussed. In general, the fiber batt will stabilize when the flow rate of the gas is between about 10,000 to about 100,000 standard liters/min/meter squared.

The foregoing specification contains certain embodiments, details and examples for the purpose of illustrating the present invention, those skilled in the art will realize that various changes and modifications may be made herein without departing from the spirit or scope of the invention. Thus, the true scope and spirit of the invention is indicated by the following claims.

We claim:

1. A process for stabilizing a pitch artifact comprising:

heating said pitch artifact to an initial process temperature at least equal to the spinning temperature of said pitch artifact while exposing said pitch artifact to an oxidizing agent for a time sufficient to stabilize said pitch artifact, wherein the pitch artifact is heated for a total processing time ranging from about 1 to about 150 minutes.

2. The process of claim 1, wherein said initial process temperature is at least 250° C.

3. The process of claim 1, wherein said oxidizing agent is transported by an inert carrier gas and the concentration of said oxidizing agent in said carrier gas is 8% or less by volume.

4. The process of claim 1, wherein said pitch artifact is heated to a temperature ranging from about 250° C. to about 500° C. in an atmosphere containing 8% or less oxygen by volume.

5. The process of claim 1 wherein the initial process temperature is greater than the spinning temperature of said pitch artifact and lower than the softening point of the pitch prior to solvation.

6. The process of claim 5 wherein the initial process temperature ranges from 100° C. to 900° C. below the softening point of the pitch prior to solvation.

7. The process of claim 6 wherein the initial process temperature is at least 400° C. below the softening point of the pitch prior to solvation.

8. The process of claim 5 wherein the initial process temperatures range from 250° C. to 500° C.

9. The process according to claim 1 wherein the initial process temperature is maintained for 1 to 60 minutes.

10. The process according to claim 9 wherein the initial process temperature is maintained for 1 to 10 minutes.

11. The process according to claim 1 wherein the concentration of the oxidizing agent in an inert gas ranges from approximately 2% by volume to 21% by volume.

12. The process according to claim 1 wherein the oxidizing agent is selected from the group consisting of: oxides of nitrogen, oxides of sulfur, carbon dioxide, chlorine and mixtures thereof.

13. The process according to claim 1 wherein the oxidizing agent is comprised within a gas stream.

* * * * *